United States Patent [19]

Jeschke et al.

[11] Patent Number: 4,702,469

[45] **Date of Patent: * Oct. 27, 1987**

[54] APPARATUS AND METHOD FOR ALIGNING SHEETS

[75] Inventors: Willi Jeschke; Gerhard Pollich, both of Heidelberg, Fed. Rep. of Germany

[73] Assignee: Heidelberger Druckmaschinen AG, Heidelberg, Fed. Rep. of Germany

[ * ] Notice: The portion of the term of this patent subsequent to May 13, 2003 has been disclaimed.

[21] Appl. No.: 845,890

[22] Filed: Mar. 28, 1986

Related U.S. Application Data

[62] Division of Ser. No. 593,648, Mar. 26, 1984, Pat. No. 4,615,520.

[30] Foreign Application Priority Data

Mar. 26, 1983 [DE] Fed. Rep. of Germany ..... 3311198

[51] Int. Cl.[4] ..... B65H 7/02

[52] U.S. Cl. ..... 271/227; 271/252

[58] Field of Search ..... 271/227, 237, 230, 231, 271/236, 245, 250, 255, 241, 249, 252

[56] References Cited

U.S. PATENT DOCUMENTS

| | | | |
|---|---|---|---|
| 3,617,048 | 11/1971 | Albert | 271/108 |
| 4,060,237 | 11/1977 | Degen et al. | 271/237 X |
| 4,184,673 | 1/1980 | Weisbach | 271/237 |
| 4,210,320 | 7/1980 | Feldkämper | 271/108 |
| 4,588,184 | 5/1986 | Jeschke | 271/250 X |
| 4,591,143 | 5/1986 | Jeschke | 271/227 |
| 4,743,277 | 7/1973 | Bolza-Schümann et al. | 271/250 X |

*Primary Examiner*—H. Grant Skaggs
*Assistant Examiner*—Gregory L. Huson
*Attorney, Agent, or Firm*—Herbert L. Lerner; Laurence A. Greenberg

[57] ABSTRACT

A device for aligning sheets fed by a sheet feeder to a sheet-processing machine includes a suction pull bar located in an aligning region of the sheet feeder, drive device for reciprocatingly displacing the suction pull bar in the plane of a sheet transversely to sheet travel direction through the sheet feeder, air control device through which the drive device is connected to a vacuum generator, positioning device for controlling the drive device the suction pull bar being acuatable for applying suction to the underside of a sheet which has reached the aligning region and after the sheet has been aligned by the leading edge thereof, the suction bar being actuatable for moving the sheet into an in-register side position and having device for applying fresh air thereto for releasing the sheet exactly in the side position simultaneously with a take-over of the sheet-in register by the sheet conveying device and a method for operating the device.

22 Claims, 8 Drawing Figures

APPARATUS AND METHOD FOR ALIGNING SHEETS

This is a division of application Ser. No. 593,648, filed Mar. 26, 1984, and now U.S. Pat. No. 4,615,520.

The invention relates to a device and a method for aligning sheets which are fed via a sheet feeder in an overlapping stream to a sheet-processing machine.

German Patent No. 2 063 818 discloses a sheet-feeding device for printing presses with a feed table, front and side lays as well as a rotating pregripper wherein the front lays swing from below into the plane of the feed table and permit alignment of the sheet or preliminary alignment thereof while it is in overlapped condition. A side pulling device operates likewise while the sheets are in overlapped condition. After the front edge and side edge have been aligned, a suction pull bar takes hold of the aligned sheet and shifts it transversely to the sheet conveying direction from the region of the side pulling device into a desired or nominal position wherein the pregripper seizes the leading edge of the sheet and carries away the sheet which has thus been prepared. During the lateral displacement of the aligned sheet, the next sheet is fed from the stream of overlapping sheets so that, in turn, the leading edge and side edge alignment can be performed.

The use of side pulling devices with fixed stops limits the maximum side aligning frequency due to the sensitivity of the side edges of very light sheets. Furthermore, the additional provision of a suction pull bar for reducing the total aligning time is costly. Finally, another problem is that the lateral displacement of the aligned sheet with the aid of the suction pull bar is not monitored in any manner. If there is no static friction between the suction pull bar and the underside of the sheet, the sheet is incorrectly transported. There is no assurance that the sheet will reach its actual desired position for transport away.

It is an object of the invention to provide a device and method for aligning sheets which are being conveyed slightly offset from one another over the feed table, this alignment being effected without the aid of fixed stops.

With the foregoing and other objects in view, there is provided, in accordance with the invention, a device for aligning sheets fed by a sheet feeder to a sheet-processing machine, comprising a suction pull bar located in an aligning region of the sheet feeder, drive means for reciprocatingly displacing the suction pull bar in the plane of a sheet transversely to sheet travel direction through the sheet feeder, air control means, through which the drive means are connected to a vacuum generator, positioning means for controlling th the drive means, the suction pull bar being acuatable for applying suction to the underside of a sheet which has reached the aligning region and after the sheet has been aligned by the leading edge thereof, the suction bar being actuatable for moving the sheet into an in-register side position and having means for applying fresh air thereto for releasing the sheet exactly in said side position simultaneously with a take-over of the sheet-in register by the sheet conveying means.

In accordance with another feature of the invention, the drive means comprise an electromotive actuator, the positioning means being controllingly connected to the actuator.

In accordance with a further feature of the invention, the electromotive actuator is a direct-current motor with a small fine constant.

In accordance with an added feature of the invention, the positioning means comprise an electro-optical scanning device.

In accordance with an additional feature of the invention the suction pull bar is formed of lightweight material and dimensionally stable.

In accordance with yet another feature of the invention, the lightweight material consists at least partly of aluminum or glass fiber-reinforced plastic material.

In accordance with again another feature of the invention the suction pull bar is disposed in the sheet feeder and is freely movable transversely to the sheet travel direction, and including means for exactly guiding the suction pull bar.

In accordance with still a further feature of the invention the drive means comprise a stepping motor and drive cams intermediate the stepping motor and the suction pull bar for driving the suction pull bar positively and with zero play.

In accordance with again a further feature of the invention the suction pull bar is formed with a plurality of suction chambers including respective outer chambers which are switchable on and off in accordance with the format of the sheet being processed.

In accordance with yet an additional feature of the invention the device for aligning sheets, fed by a sheet feeder to a sheet-processing machine includes a suction pull bar mounted in an aligning region of the sheet feeder and displaceable transversely to sheet travel direction through the sheet feeder downwardly swingable front lays located at a lower end of the feed table, the suction pull bar and the front lays defining a scanning gap therebetween which extends parallel the suction pull bar, the suction pull bar having a suction surface disposed in the plane of travel of the sheet feeder, the suction surface being engageable with a sheet of a continuous overlapping stream thereof for applying suction firmly thereto to prevent slippage, the sheet being up against the front lays and having been aligned at the leading edge thereof.

In accordance with still an additional feature of the invention device for aligning sheets fed by a sheet feeder to a sheet processing machine includes an aligning cylinder disposed downstream of the sheet feeder in sheet travel direction through the sheet feeder, and at least one suction pull bar mounted in the aligning cylinder and displaceable transversely to the sheet travel direction.

In accordance with still an added feature of the invention aligning cylinder is disposed between the full table and a pregripping cylinder, and a plurality of the suction pull bars are disposed in the aligning cylinder symmetrically distributed over the circumference thereof, and including a plurality of front lays located on the aligning cylinder, each of the front lays being operatively associated with a respective one of the suction pull bars.

In accordance with again another feature of the invention there is provided a method for driving the suction pull bars mounted on a side wall of the sheet processing machine.

In accordance with again a further feature of the invention there is provided a method which includes air control means for the suction pull bars, said driving means being connected via the air control means to a vacuum generator, the air control means being mounted on a side wall of the processing machine opposite the first-mentioned side wall.

In accordance with still another feature of the invention the first-mentioned side wall is on the drive side of the machine, and the opposite side wall in on the operator side of the machine.

In accordance with yet a further feature of the invention the positioning means have parts thereof disposed above the aligning cylinder and directly upstream of the pregripper cylinder in sheet travel direction of the sheet feeder.

In accordance with again an additional feature of the invention the positioning means comprise two sensors axially displaceably mounted on a cross member above the aligning cylinder, the cross member being supported by the side walls of the machine.

In accordance with still an additional feature of the invention there is provided a method including two sheet-guiding segments defining a scanning gap in the periphery of the aligning cylinder in vicinity of the sensors upstream of suction pull bars, respectively.

In accordance with yet a further feature of the invention the sheet-grinding segments have a circumferential length slightly greater than that of the scanning region and are mounted in the aligning cylinder so as to be axially adjustable therein.

In accordance with still another feature of the invention the air control means comprise a valve ring mounted on the side wall of the processing machine, and a valve body mounted on and rotatable with a shaft of the aligning cylinder.

In accordance with still a further feature of the invention the valve ring has a control surface, and a suction opening and a fresh-air opening are formed at an identical radial level in the control surface, and the valve body has a control surface formed with respective air control openings uniformly distributed in the control surface for each of the suction pull bars at identical radial level with that of the openings formed in the valve ring, suction opening and the fresh-air opening having a width approximately equal to that of a respective air control opening.

In accordance with yet an additional feature of the invention the driving means for the suction pull bars comprise a stepping motor mounted on the outside of the side wall of the machine, the the stepping motor being coupled with zero play via a cam drive to a drive rod axially displaceably held in two spherical bushings, the drive rod carrying, at an end thereof within the side wall of the machine, a control segment positively couplable via two drive rollers with each of the suction pull bars of the aligning cylinder.

In accordance with again an additional feature of the invention there is provided a method which includes a return disc mounted on the minor surface of the machine side wall, the control segment being displaceably mounted in a recess formed in the return disc.

In accordance with still another feature of the invention there is provided a method which includes fixed guide means located adjacent the control segment for preventing, through the intermediary of a guide roller, turning of the control segment.

In accordance with again a further feature of the invention the rod has two bearing blocks whereon a respective cam roller is supported, said cam rollers cooperating with a drive cam on a shaft stub of said stepping motor, said two drive cams being so disposed and constructed that spacing in diagonal direction between respective paths of said drive cams, with respect to the rotational axis of the stepping motor, is constant.

In accordance with yet an additional feature of the invention the driving means is adjustable for left-hand alignment of sheets.

In accordance with still a further feature of the invention the driving means is adjustable for right-hand alignment of the sheets.

In accordance with again an additional feature of the invention the control means are disposed substantially in the middle of said aligning cylinder.

In accordance with yet a further feature of the invention there is provided a method which includes two suction pull-type lays replacing said suction pull bar and being likewise displaceable transversely to sheet travel direction, said suction pull-type lays being mounted in the feed table, at least one of said suction pull-type lays being driven.

In accordance with another aspect of the invention, there is provided a device wherein one of said suction pull-type lays is disposed on a drive side of the machine, and the other of said suction pull-type lays is disposed on an operator side of the machine.

In accordance with a concomitant feature of the invention a method for aligning sheets fed by a sheet feeder to a sheet-processing machine which comprises taking hold of a sheet by a side aligning device, the sheet having previously been aligned at the leading edge thereof, controlling said side aligning device so as to move the sheet transversely to sheet feed direction through the sheet feeder into an in-register side position of the sheet, and holding the sheet by the side aligning device in the side position thereof until sheet conveying means take over the sheet in register.

The suction pull bar according to the device according to the invention transports the sheet, which is to be laterally aligned, by means of static friction. By appropriately arranging the positioning means, assurance can be provided that the sheet will also, in fact, reach its desired lateral position. The method according to the invention and the device for performing this method thus not only render superfluous any side pulling devices with stops, but also permit reliable lateral displacement of the sheet into in-register position. By disposing the suction pull bar directly upstream of the front lays, it is possible to reduce the distance between the overlapping sheets in the continuous stream to approximately half of what is presently customary in sheet feeders. All of these advantages contribute considerably towards making possible a substantial increase in the rate of sheet feeding and alignment, without any deterioration in accuracy thereby suffering.

The arrangement of the suction pull bars in an aligning cylinder shich, although rotating more slowly, otherwise rotates synchronously with the cylinders of the printing units, ensures alignment of the sheets laterally during transfer from the feed table to the pregripper cylinder. The sheet-feeding speed can consequently be considerably increased because it is no longer necessary for the sheet to come to rest for the purpose of leading and side edge alignment, respectively.

Other features which are considered as characteristic for the invention are set forth in the appended claims.

Although the invention is illustrated and described herein as embodied in an apparatus and method for aligning sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
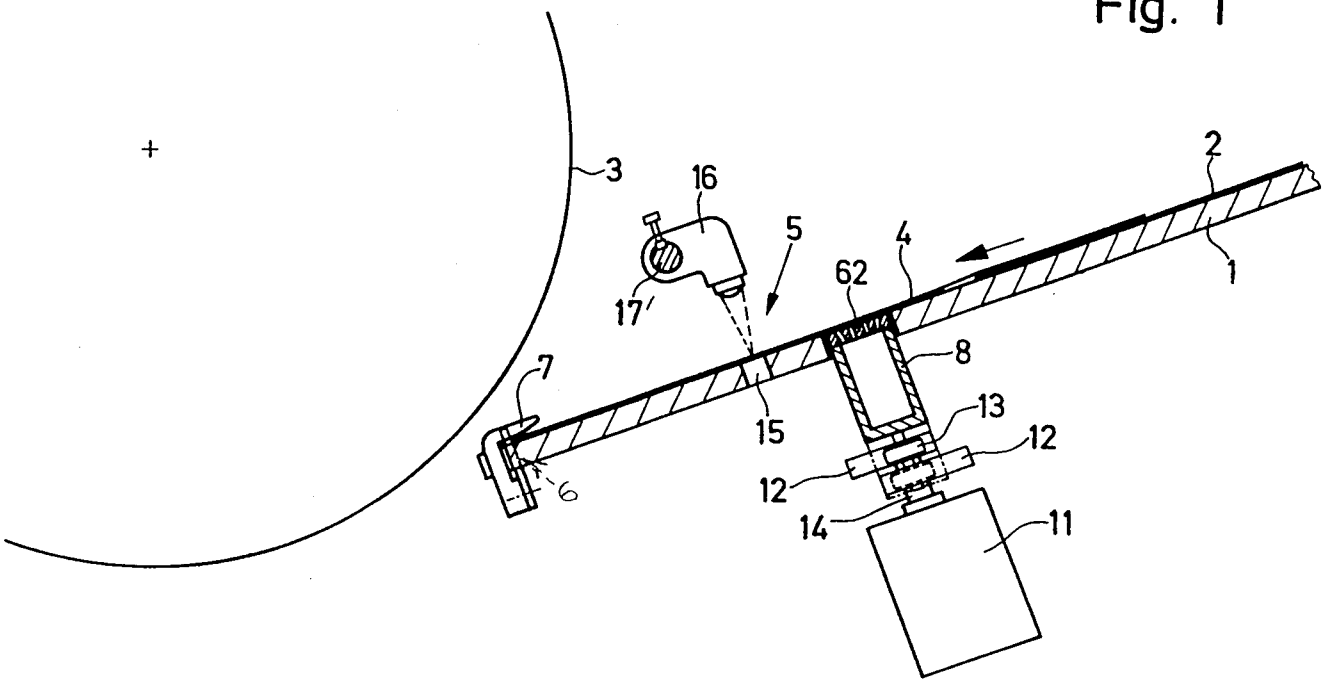
FIG. 1 is a vertical sectional view of a feed table with a suction pull bar according to the invention.
Figure 2:
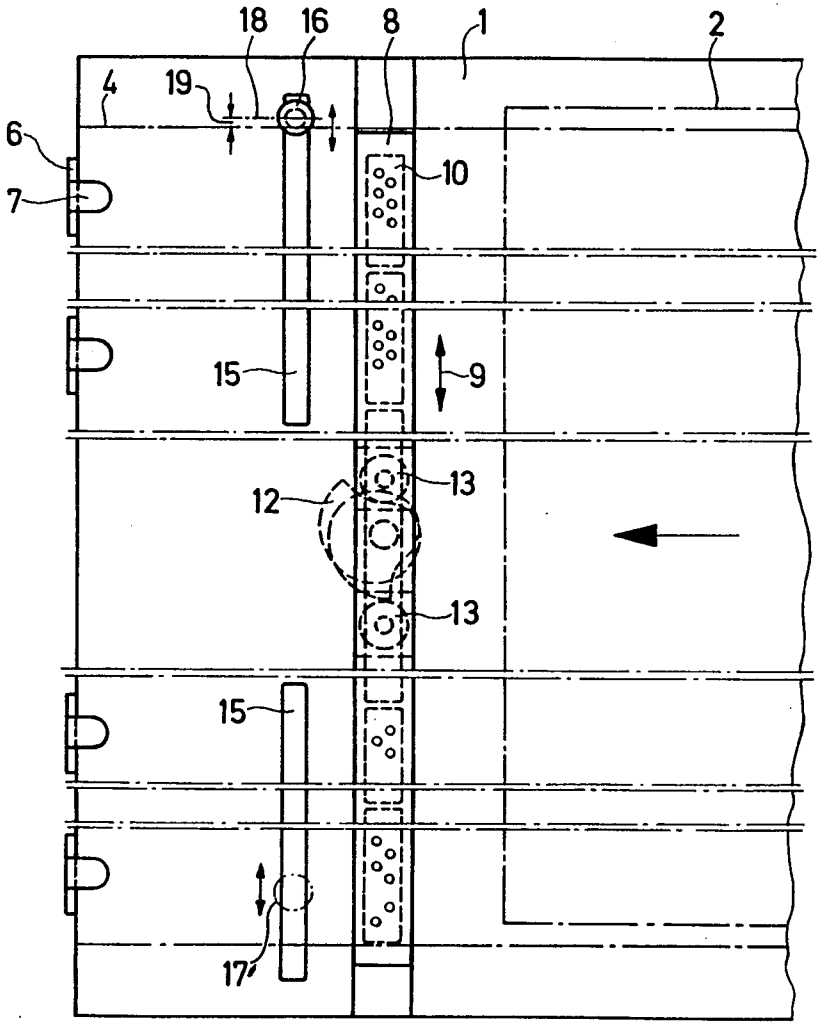
FIG. 2 is a fragmentary top plan view of FIG. 1 showing the feed table with the suction pull bar.
Figure 3:
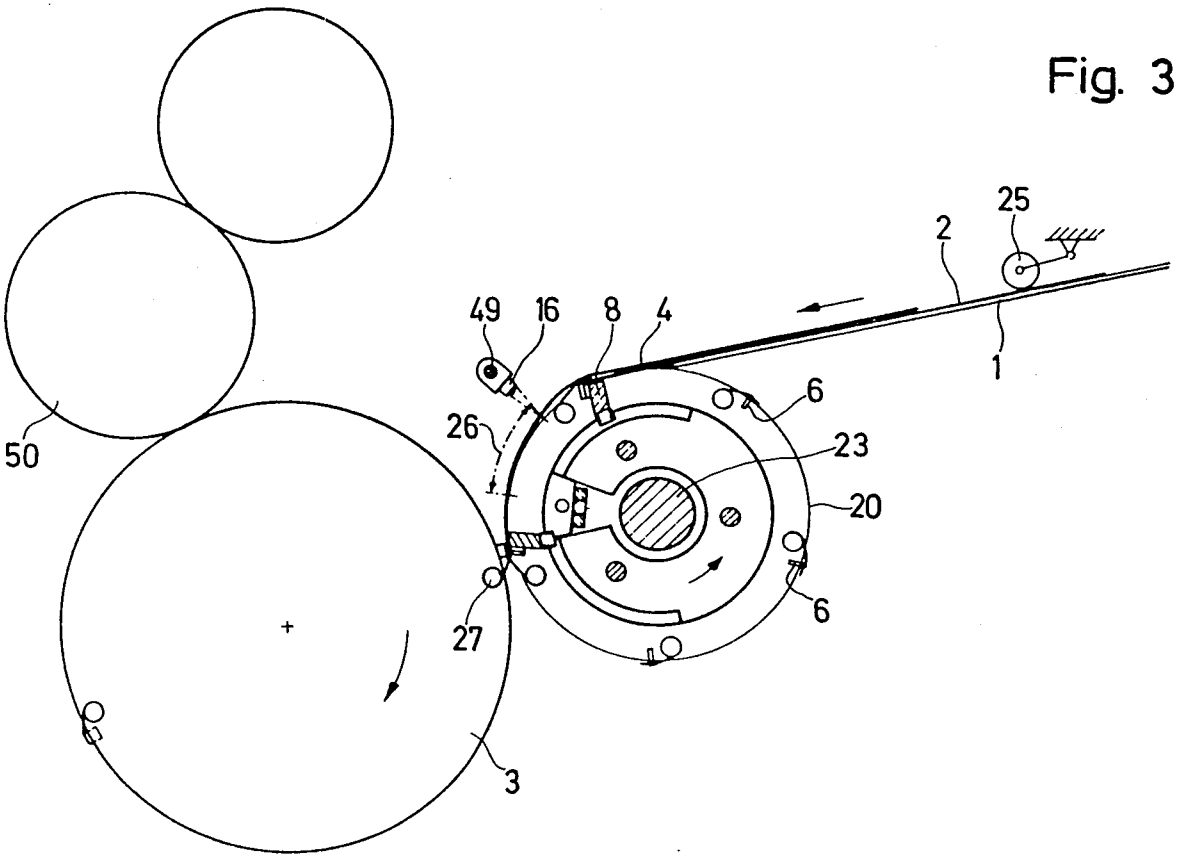
FIG. 3 is a diagrammatic elevational view, partly in section, of a feed table with an aligning cylinder, according to the invention.

Referring now to the drawing and first, particularly, to FIGS. 1 and 2 thereof, there are shown sheets 2 fed in a continuous overlapping stream over a feed table 1 to a pregripper cylinder 3. The sheets are moved along by conventional non-illustrated transport elements. The foremost sheet 4 in the stream covers the following sheet or sheets 2 and is located in the so-called aligning region 5. The leading edge of the front sheet 4 in the stream is up against the front lays 6. By means of the drive of the transport elements of the feed table 1, the leading edge of the sheet 4 is aligned with the aid of the front lays 6. To ensure that the sheet leading edge is reliable laid against the front lays 6, so-called front lay covers 7 are attached to the downwardly swingable front lays 6.

Extending over almost the entire width of the feed table, a suction pull bar 8 is provided in the aligning region 5. This suction pull bar is mounted in the feed table 1 so as to be movable reciprocatingly transversely to the sheet conveying direction, as indicated by the double-headed arrow 9. The suction pull bar 8 is formed of several suction chambers 10 which are switchable on and off i.e. connectible and disconnectible. It is made preferably from a light material, for example aluminum or glass fiber-reinforced plastic material. The suction pull bar 8 is driven by a stepping motor 11, for example a direct-current motor with a small time constant. The transmission of power from the stepping motor 11 to the suction pull bar 8 is effected by two drive cams 12 and two cam rollers 13. The two cams 12 are attached to the shaft stub 14 of the stepping motor 11 in a manner that the sum of the distances of the opposite sections of the paths of both cams 12 from the rotational axis of the stepping motor 11 is always the same. This makes it possible for the two cam rollers 13 which are rotatably mounted on the suction pull bar 8 to roll with zero play i.e. play-free on the drive cams 12.

Provided in the feed table 1 between the suction pull bar 8 and the front lays 6 are two scanning gaps 15, respectively, one on the drive side and one on the operator side. On the drive side above the feed table 1, a sensor 16 is mounted on a cross-member 17 so as to be laterally adjustable. This sensor 16 forms part of an otherwise non-illustrated positioning device such as is for example, described in copending application, Ser. No. 581,281, filed Feb. 17, 1984 and assigned to the same assignee as that of the instant application. As indicated by the circle 17 shown in phantom, the sensor 16 can also be provided above the scanning gap 15 on the operator side.

In the embodiment illustrated in FIGS. 1 and 2, the sensor 16 and the scanning gap 15 are located between the suction pull bar 8 and the front lays 6. It is also quite possible, however, for the suction pull bar 8 to be disposed directly before the front lays 6. In such a case, the order or succession of the scanning and aligning means might be as follows: First of all, the sheet leading edge passes the suction pull bar 8, then the scanning gap 15, and comes up finally against the front lays 6.

The operating principle of the aforedescribed aligning device according to FIGS. 1 and 2 is as follows:

As mentioned at the introduction hereto, the sheets are advanced in a continuous overlapping stream across the feed table 1. The side positions of the advanced sheets differ little from one another. One sheet 2 may, for example, be advanced in the position shown in FIG. 2 into the aligning region 5. The sheet 2 covers the reflection area and measuring area, respectively, of the sensor 16 and comes up finally against the front lays 6. The leading edge of the sheet is aligned due to the forward drive of the transport elements in the feed table. Then, the suction pull bar 8 applies suction firmly to the sheet so that static friction is produced. Immediately thereafter, the stepping motor 11, by way of the drive cams 12 and the cam rollers 13, moves the suction pull bar 8 in the direction towards the operator side. In doing so, the side edge of the sheet 2 on the drive side passes the measuring line 18 of the sensor 16. The non-illustrated positioning device controls the stepping motor 11 then so that the laterally transported sheet 2 is moved laterally only over a constant distance 19. Then, the suction pull bar 8 comes to rest, the sheet is laterally aligned and now lies in the position of sheet 4. This is the desired or nominal position. The sheet can then be transferred to the pregripper cylinder 3. The instant the grippers of the pregripper cylinder 3 have taken hold of the sheet 4, the front lays 6 having already been swung downwardly in the interim, the suction pull bar 8 releases the sheet 4 and the then-registered sheet 4 can be transported further. While the sheet 4 is being transported away, alignment of the next sheet 2 in the overlapping stream begins.

Figure 4:
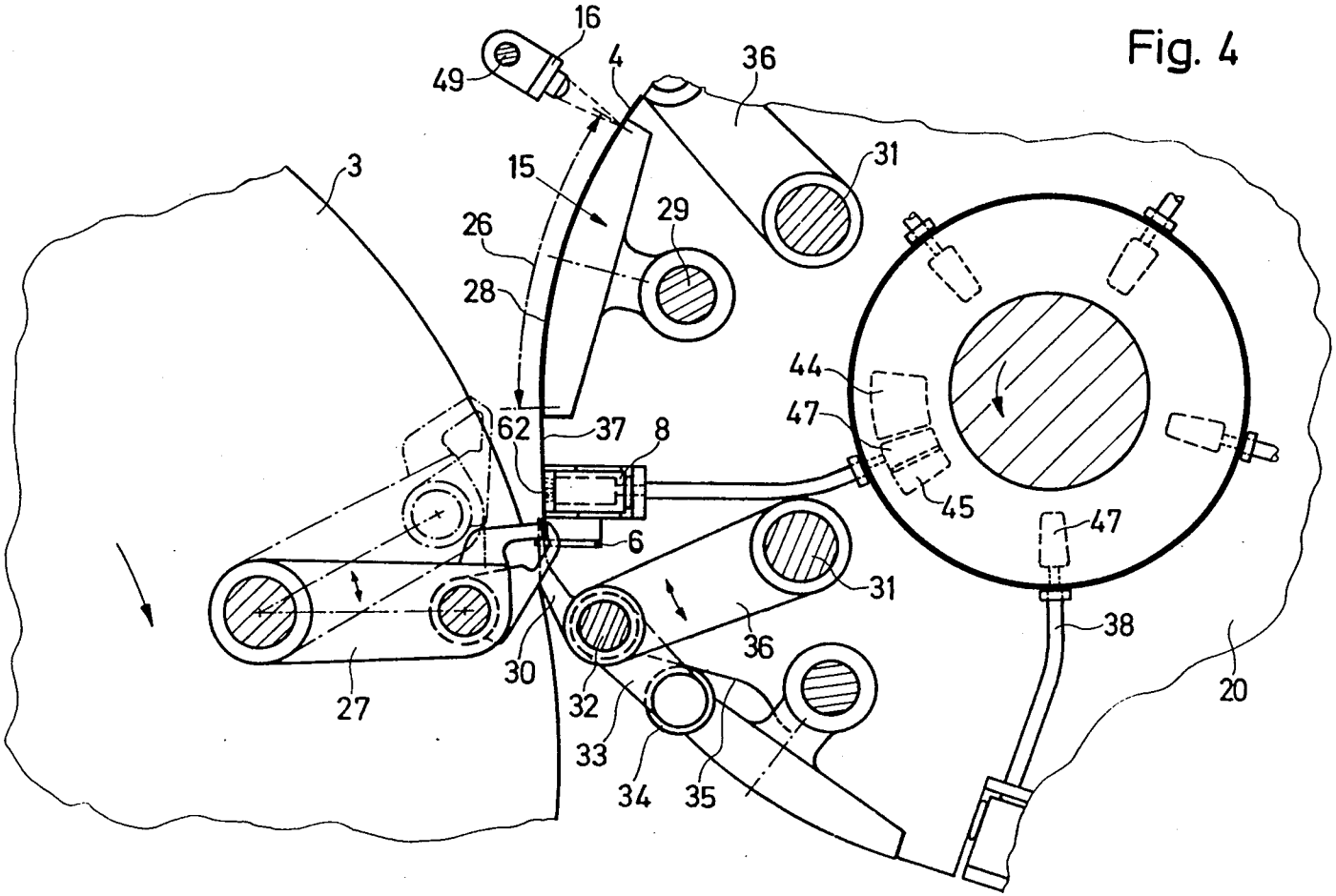
FIG. 4 is an enlarged fragmentary view of FIG. 3 showing the aligning cylinder in the aligning region.
Figure 5:
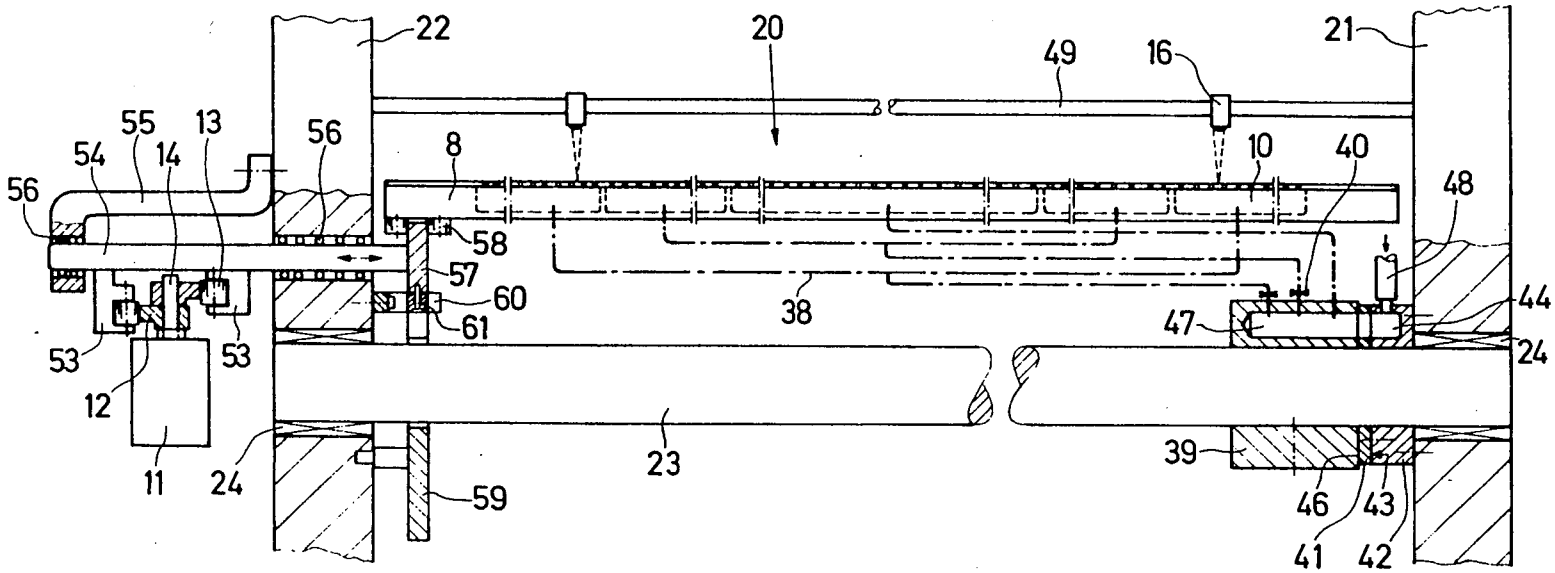
FIG. 5 is a diagrammatic, partly schematic and partly sectional view of the sheet feeder at the level of the aligning cylinder as viewed from the left-hand side of FIG. 3 and showing the drive and the air control of a suction pull bar.

Another embodiment of the invention is shown in FIGS. 3 to 8. In this case, both the leading edge and the side edge are aligned while there the sheets are flow-fed. Below the lower end of the feed table 1, an aligning cylinder 20 is mounted in the side walls 21 and 22 of the sheet-processing machine. As shown in FIG. 5, the shaft 23 of the aligning cylinder 20 is supported in two roller bearings 24.

The aligning cylinder 20 is followed by a half-revolution pregripper cylinder 3 which transfers the taken-over sheet to the impression cylinder 50 of the first printing unit of the sheet-processing machine. Shown above the feed table 1 in FIG. 1 are transport elements 25 which ensure that the sheets 2, which are advanced in a continuous overlapping stream over the feed table 1, are fed to the aligning cylinder 20 and, after coming up against a line of front lays 6, are held fast by a suction pull bar 8. After the foremost sheet 4, respectively, in the overlapping stream has had suction firmly applied thereto by the suction pull bar 8, the sheet 4 is conveyed into the aligning region 26 by the aligning cylinder 20 rotating counterclockwise. In accordance with the aligning operation to be described hereinafter, the aligning cylinder 20 transfers the aligned sheet 4 to a gripper bridge 27 of the pregripper cylinder 3.

The aligning cylinder 20 is provided with five suction pull bars 8 which are symmetrically distributed over the circumference thereof. Accordingly, the surface velocity of the cylinder 20 is approximately five times lower than that of the impression cylinder 50.

Viewed in the direction of rotation of the aligning cylinder 20, a suction pull bar 8 is disposed directly before each row of front lays 6. The special construction of the aligning cylinder 20 is shown in greater detail in FIGS. 4 and 5. Provided between the respective aligning elements 6 and 8 are sheet guiding segments 28 which are mounted on a cross-member 29 so as to be adjustable in the axial direction of the aligning cylinder 20 and so that between any two of them it is possible to form a scanning gap 15. The circumferential length of the sheet guiding segments 28 is slightly greater than the circumferential length of the aligning region 26.

Mounted in the side walls 21 and 22 above the aligning cylinder 20 between the feed table 1 and the pregripper cylinder 3 is a cross-member or traverse 49 which extends transversely over the machine and to which there are adjustably movably attached one or two sensors 16 of a non-illustrated positioning device. These sensors 16 register the time at which the side edge of the sheet 4 passes. They are set to the sheet format being processed. Depending upon the position of a sensor 16, the sheet guiding segments 28 provided in this region must be disposed in a manner that a scanning gap 15 is formed directly below the sensor 16.

The two gripper bridges 27 are tiltably or pivotably disposed, in a conventional manner in the pregripper cylinder 3 so that, after transfer of the sheet, they gradually swing back from an extended or swung-out position onto the circumference of the feed cylinder 3 so that the sheet 4 is accelerated from the low speed of the aligning cylinder 20 gradually to the higher circumferential speed of the pregripper cylinder 3.

To ensure reliable laying or engagement of the sheet leading edge against the front lays 6, front lay cover grippers 30 are provided in the aligning cylinder 20, the front lay cover grippers 30 being swivellable on a shaft 31 and tiltable on a further gripper shaft 32. The front lay cover grippers 30 are rigidly connected to a guide roller lever 33 on which a guide roller 34 is rotatably mounted. During the swivelling of the front lay cover grippers 30, this guide roller 34 runs along a control cam 35 which rotates with the aligning cylinder 20. Due to the swivelling of the carriers 36 of the front lay cover grippers 30 by means of the shaft 31, the front lay cover grippers 30 are lifted off the sheet and are then pulled or drawn into the circumference of the aligning cylinder 20. When the carriers 36 are moved in the opposite direction, the front lay cover grippers 30 initially swing out of the retracted position thereof and are then brought to the set distance or spacing from the sheet.

The region of the sheet guiding area of the aligning cylinder 20 from the front lays 6 to the beginning of the sheet guide segments 28 is flat so that the sucking of the underside of the sheet by the suction pull bar is not hindered unnecessarily. Furthermore, the sheet leading edge must be absolutely flat up against the front lays 6. The sheet guiding area may also be curved.

As shown in greater detail in FIG. 5, the suction pull bar 8 is formed of a number of separate suction chambers 10. These suction chambers 10 are connected via air lines 38 to a valve body 39 in such a manner that the two outer suction chamber groups can be switched on and off by means of valves 40, depending upon the size of sheet being processed. The valve body 39 is rigidly attached to the shaft 23 of the aligning cylinder 20. Through the intermediary of a seal 41, the valve body 39 cooperates with a valve ring 42 which is mounted on the side wall 21 of the sheet-processing machine. Provided in the control surface 43 of a valve ring 42 at an identical radial height are a suction opening 44 and a fresh air opening 45. Conversely, the control surface 46 of the valve body 39 is formed with an air control opening 47 to which all of the air lines 38 of the suction chambers 10 are connected. As shown in FIG. 4, each air control opening 47 is at the same radial height or level as that of the suction and fresh air openings. The width of the air control opening 47 corresponds approximately to the distance between the suction opening 44 and the fresh air opening 45. Each suction pull bar 8, of course, has an air control opening 47 assigned thereto. The suction opening 44 is connected via an air line 48 to a non-illustrated vacuum generator. The dimensions of the suction opening 44, the fresh air opening 45 and the air control opening 47 are such that the vacuum generated in the respective suction pull bar 8 for holding the sheet 4 is cut off immediately by the supply of fresh air, the instant the gripper bridge 27 has firmly accepted the sheet leading edge.

Because FIG. 5 is a sectional view of the feeder 1 and the aligning cylinder 20 as seen from the sheet-processing machine, the drive of the suction pull bars 8 is at the drive side of the sheet feeder. The drive is formed, firstly, of a stepping motor 11 with reduction gear which is attached to the side wall 22 by suitable non-illustrated means. Mounted on the shaft stub 14 are two identical drive cams 12 which are diametrically opposed in a manner that the two cam paths thereof are always the same distance apart in the diagonal direction to the motor. A respective cam roller 13 runs on each of these two drive cams 12. These cam rollers 13 are each mounted via respective bearing block 53 on a drive rod 54. Drive cams 12 and cam rollers 13 cooperate in such a manner that the rotational movement of the shaft stub 14 of the stepping motor 11 is transmitted without play to the drive rod 54. The drive rod 54 is axially displaceably mounted, on the one hand, in the guide bracket 55 and, on the other hand, in the machine side wall 22. In both cases, it is held in spherical bushings 56. The free end of the drive rod 54 at the inside of the machine side wall 22 is provided with a control segment 57 which can come into engagement with drive rollers 58 of each suction pull bar 8 in such a manner that the axial drive motion of the drive rod 54 is transmitted without play to the respective suction pull bar 8 to be driven.

The 4 control segment 57, as viewed in the axial direction of the drive rod 54, is displaceably housed in a recess of a return disc 59. A guide 60 also projects into this recess formed in the return disc 59. Running in the guide 60 is a guide roller 61 which is rotatably mounted on the underside of the control segment 57. Assurance is thereby provided that the drive rod 54 cannot turn. Both the guide 60 as well as the return disc 59 are mounted on the side wall 22.

Figure 8:
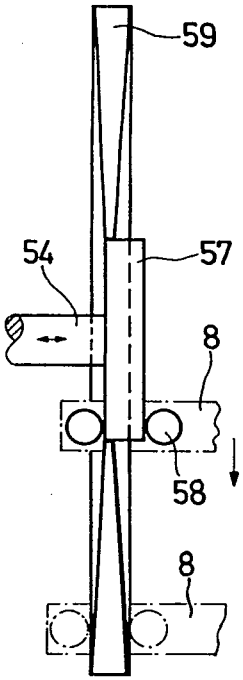
FIGS. 6 to 8 are enlarged fragmentary views of FIG. 5 as seen from the bottom thereof and showing details of the drive of the suction pull bar.
Figure 7:
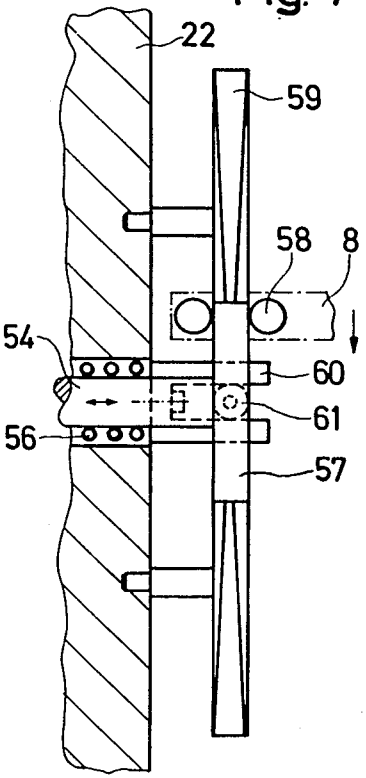
Figure 6:
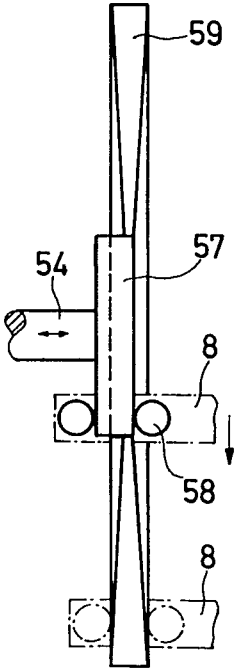

FIGS. 6 to 8 show the essential working positions of the control segment 57. In FIG. 7, the control segment 57 is in the middle zero position thereof. It assumes this position before a suction pull bar is to be adjusted. As can be seen, the drive rollers 58 of a suction pull bar 8 which are normally guided by the return disc 59 i.e. the suction pull bar 8 rotating with the aligning cylinder 20 have just reached the control segment 57. At this instant, the adjustment operation can begin. If the sensor 16 on the operator side is in operation, the stepping motor 11, through the shaft stub 14, turns the drive cams 12 in such a manner that the drive rod 54 is pulled in the direction of the drive side until, finally, after the passing of the sheet edge has been signaled by the sensor 16, a precisely determined residual travel is covered. The drive rod remains in this position, as shown in FIG. 6. When the stepping motor 11 is correspondingly driven, the control segment 57 stops before reaching the maximum stroke and thereby guides the adjusted suction pull bar 8 in this desired position until the aligning operation is concluded and the aligned sheet 4 has been transferred to further-conveying means. After the adjusting operation, the return disc 59 returns the suction pull bar 8 to the zero position thereof.

If, on the other hand, the sensor 16 on the drive side is in operation, the drive rod 54 is moved by the stepping motor 11 into the interior of the machine, at most, in fact, into the position shown in FIG. 8. With appropriate positioning, the control segment 57 comes to a stop before the end position and guides the adjusted suction pull bar 8 in this position until the laterally aligned sheet 4 has been accepted or taken over by the feed cylinder 3. After this adjustment, too, the adjusted suction pull bar is returned to the zero position thereof by means of the return disc 59.

The operation of the last-described embodiment of the invention is as follows: The transport means 25 on the feed table 1 convey or advance the sheets 2 in a continuous overlapping stream slightly faster than the peripheral speed of the aligning cylinder 20. Due to this difference on speed, the foremost sheet 4 in the stream is reliably laid against the moving row of the front lays 6. T ensure this, the front lay cover grippers 30 are in such a position that the leading edge of the sheet cannot ride up, but is clearly laid against the front lays 6, as a result of which, due to the forward drive of the stream and, if necessary, or desirable, also the transport elements in the feed table 1, the leading edge of the sheet 4 is aligned before the aligning region region 26 is reached.

After the alignment of the leading edge which is moving, the side edge alignment then begins, in the so-called aligning region 26 during the further travel or transport of the sheet 4, in a manner that, because of the air control of the suction pull bar 8, the sheet is firmly sucked by the suction pull bar 8 so that there is static friction between the underside of the sheet and the suction surface 62 of the suction pull bar 8. The sheet 4 has, therefore, non-slippably seized. At this time, the suction pull bar 8 has assumed the position thereof shown in FIG. 7 i.e. its drive rollers 58 have zero-play contact with the control segment 57. Via the stepping motor 11, the cam drive 12/13 and the drive rod 54, the control segment 57 is then moved towards the end position according to FIG. 6. The sheet is thus shifted towards the drive side whereby, at some point or other in the aligning region 26, the operator-side sheet edge passes the sensor 16 and, due to the scanning gap 15, the light emitted by the sensor 16 is no longer reflected, as a result of which the positioning means controls the stepping motor 11 in a manner that, from that instant, the sheet 4 covers only a specific distance, for example 2.00 mm.

This entire side-aligning operation takes place while the suction pull bar 8 is rotating in the aligning region 26. The suction pull bar 8 then firmly holds the sheet further in the aligned position. In addition, the front lay cover grippers 30 can also be pressed against the sheet leading edge in order to ensure absolutely reliable guidance of the aligned sheet until the final transfer to the gripper bridge 27 of the feed cylinder 3. As shown in FIG. 4, the air control opening 47 of the valve body of that suction pull bar 8, which has just been supplied with vacuum, has reached the fresh air opening 45 so that the vacuum suddenly stops as a result of the supply of fresh air, and the static friction between the suction surface 62 and the underside of the sheet 4 is cancelled so that nothing prevents the in-register sheet 4 from being accepted by the gripper bridge 27. However, before the gripper surface of the gripper bridge 27 with the sheet leading edge is moved from the flat sheet guide surface in the direction of the circumference of the feed cylinder 3, a swivelling of the carriers 36 via the shaft 31 occurs, whereby, according to the appropriate guidance of the control cam 35, the front lay cover grippers 30 are lifted off the sheet leading edge and are finally swung into the aligning cylinder 20. The complete take-over of the aligned sheet 4 by the feed cylinder 3 can now occur. Before the suction pull bar 8 which has just been used reaches a position according to FIG. 3 as a result of the further rotation of the aligning cylinder 20 i.e. before it is again directly under the lower end of the feed table 1, the suction pull bar 8 is moved again into the center zero position thereof according to FIG. 7, and the front lay cover grippers 30 are likewise again swung out so that there is assurance that the leading edge of the sheet 4 will come reliably up against the front lays 6.

Of course, as aforementioned, the invention is not limited to the depicted embodiments. For example, the suction pull bar can be replaced by preferably two suction pull-type lays which are likewise mounted in the feed table and are displaceable transversely to the sheet conveying or advancing direction. In this case, one suction pull-type lay is on the drive side and the other on the operator side. Both suction pull-type lays are driven by appropriate means. For the purpose of different positioning of the two side pull-type lays, it is possible to provide a control device which influences or has an effect upon the positioning device.

The advantage of such a modification to the invention is that it is possible during side alignment to tauten or compress the sheet leading edge.

A further modification or the aforedescribed embodiments as one wherein the air control means are disposed in the center of the aligning cylinder or on the drive side.

The foregoing is a description corresponding in substance to German Application No. P 33 11 198.7, dated Mar. 26, 1983, the International priority of which is being claimed for the instant application, and which is hereby made part of this application. Any material discrepancies between the foregoing specification and the aforementioned corresponding German application are to be resolved in favor of the latter.

We claim:

1. Device for aligning sheets fed by a sheet feeder to a sheet processing machine, comprising an aligning cylinder disposed downstream of the sheet feeder in sheet travel direction through the sheet feeder, a plurality of suction pull bars mounted in said aligning cylinder and drive means for displacing said suction pull bars transversely to the sheet travel direction, and positioning means for controlling said drive means, said aligning cylinder being disposed between a feed table and a pregripping cylinder, said plurality of suction pull bars being disposed in said aligned cylinder symmetrically distributed over the circumference thereof, and a plurality of front lays located on said aligning cylinder, each of said front lays being operatively associated with a respective one of said suction pull bars.

2. Device according to claim 1 wherein said suction pull bars are freely movable transversely to said sheet travel direction, and including means for exactly guiding said suction pull bar.

3. Device according to claim 1 wherein said drive means comprise a stepping motor and drive cams intermediate said stepping motor and said suction pull bars for driving said suction pull bars positively and with zero play.

4. Device according to claim 1 wherein said suction pull bars are formed with a plurality of suction chambers including respective outer chambers which are switchable on and off in accordance with the format of the sheet being processed.

5. Device according to claim 1 wherein said positioning means have parts thereof disposed above said aligning cylinder and directly upstream of said pregripper cylinder in sheet travel direction of the sheet feeder.

6. Device according to claim 1 wherein said drive means comprise an electromotive actuator, said positioning means being controllingly connected to said actuator.

7. Device according to claim 6 wherein said electromotive actuator is a direct-current motor with a small fine constant.

8. Device according to claim 6 wherein said positioning means comprise an electro-optical scanning device.

9. Device according to claim 6 wherein said suction pull bars are formed of lightweight material and dimensionally stable.

10. Device according to claim 9 wherein said lightweight material consists at least partly of aluminum or glass fiber-reinforced plastic material.

11. Device according to claim 1 wherein said means for driving said suction pull bars are mounted on a side wall of the sheet processing machine.

12. Device according to claim 11 including air control means for said suction pull bars, said driving means being connected via said air control means to a vacuum generator, said air control means being mounted on a side wall of the processing machine opposite said first-mentioned side wall.

13. Device according to claim 12 wherein said first-mentioned side wall is on the drive side of the machine, and said opposite side wall is on the operator side of the machine.

14. Device according to claim 12 wherein sid air control means are disposed substantially in the middle of said aligning cylinder.

15. Device according to claim 12 wherein said air control means comprise a valve ring mounted on said side wall of the processing machine, and a valve body mounted on and rotatable with a shaft of said aligning cylinder.

16. Device according to claim 15 wherein said valve ring has a control surface, and a suction opening and a fresh-air opening are formed at an identical radial level in said control surface, and said valve body has a control surface formed with respective air control openings uniformly distributed in said control surface for each of said suction pull bars at identical radial level with that of said openings formed in said valve ring, said suction opening and said fresh-air opening having a width approximately equal to that of a respective air control opening.

17. Device according to claim 11 wherein said driving means for said suction pull bars comprise a stepping motor mounted on the outside of the side wall of the machine, said stepping motor being coupled with zero play via a cam drive to a drive rod axially displaceably held in two spherical bushings, said drive rod carrying, at an end thereof within the side wall of the machine, a control segment positively couplable via two drive rollers with each of said suction pull bars of said aligning cylinder.

18. Device according to claim 17 including a return disc mounted on a minor surface of the machine side wall, said control segment being displaceably mounted in a recess formed in said return disc.

19. Device according to claim 17 including fixed guide means located adjacent said control segment for preventing, through the intermediary of a guide roller, turning of said control segment.

20. Device according to claim 17 wherein said rod has two bearing blocks whereon respective cam rollers are supported, said cam rollers cooperating with two drive cams on a shaft stub of said stepping motor, said two drive cams being so disposed and constructed that spacing in diagonal direction between respective paths of said drive cams, with respect to the rotational axis of said stepping motor, is constant.

21. Device according to claim 20 wherein said driving means is adjustable for left-hand alignment of sheets.

22. Device according to claim 20 wherein said driving means is adjustable for right-hand alignment of the sheets.

* * * * *